US011378239B2

(12) United States Patent
Zou

(10) Patent No.: US 11,378,239 B2
(45) Date of Patent: Jul. 5, 2022

(54) DESK LAMP

(71) Applicant: OPPLE LIGHTING CO., LTD., Shanghai (CN)

(72) Inventor: Donghong Zou, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/105,852

(22) Filed: Nov. 27, 2020

(65) Prior Publication Data

US 2021/0080067 A1 Mar. 18, 2021

Related U.S. Application Data

(63) Continuation of application No. PCT/CN2019/086643, filed on May 13, 2019.

(30) Foreign Application Priority Data

May 29, 2018 (CN) ..... 201820814395.2

(51) Int. Cl.
*F21S 6/00* (2006.01)
*F21V 17/18* (2006.01)
(Continued)

(52) U.S. Cl.
CPC ..... *F21S 6/003* (2013.01); *F21V 17/18* (2013.01); *F21V 21/002* (2013.01); *F21V 21/14* (2013.01); *F21V 21/26* (2013.01); *F21V 23/003* (2013.01); *F21V 23/008* (2013.01); *F21V 23/06* (2013.01); *F21V 17/007* (2013.01)

(58) Field of Classification Search
CPC ..... F21S 6/002; F21S 6/003; F21V 21/002; F21V 21/06; F21V 21/14; F21V 17/18; F21V 23/003; F21V 23/008; F21V 23/06; F21V 21/26; F21V 17/007
See application file for complete search history.

(56) References Cited

U.S. PATENT DOCUMENTS 7,789,526 B2 * 9/2010 Gibbons ..... F21S 6/003 362/198
2008/0274641 A1 * 11/2008 Weber ..... F21V 23/06 439/541.5
(Continued)

FOREIGN PATENT DOCUMENTS

CN 203115657 U 8/2013
CN 206429937 U 8/2017
(Continued)

OTHER PUBLICATIONS

Jack Lin, "Description DE29618002U1", Dec. 5, 1996, Patent Translate Powered by EPO and Google, pp. 1-4.*
(Continued)

*Primary Examiner* — Alan B Cariaso
(74) *Attorney, Agent, or Firm* — Arch & Lake LLP

(57) ABSTRACT

The present disclosure discloses a desk lamp, which includes a lamp cap, a chassis, and a connector connecting the lamp cap and the chassis. The connector is provided with a plurality of clasps, the chassis is provided with a plurality of connection holes, and the clasps are matched and clasped with the connection holes so as to connect the connector and the chassis.

15 Claims, 9 Drawing Sheets

(51) Int. Cl.

| | |
|---|---|
| ***F21V 21/14*** | (2006.01) |
| ***F21V 23/00*** | (2015.01) |
| ***F21V 23/06*** | (2006.01) |
| ***F21V 21/002*** | (2006.01) |
| ***F21V 21/26*** | (2006.01) |
| ***F21V 17/00*** | (2006.01) |

(56) References Cited

U.S. PATENT DOCUMENTS

| | | | | |
|---|---|---|---|---|
| 2011/0103052 | A1* | 5/2011 | Zheng | F21V 21/06 362/235 |
| 2013/0088876 | A1* | 4/2013 | Harbers | F21V 17/164 362/294 |
| 2017/0009941 | A1* | 1/2017 | Chen | F21S 6/002 |

FOREIGN PATENT DOCUMENTS

| | | | | |
|---|---|---|---|---|
| CN | 207132154 | U | 3/2018 | |
| CN | 107893952 | A | 4/2018 | |
| DE | 29618002 | U1 * | 12/1996 | F21S 6/003 |

OTHER PUBLICATIONS

International Search Report of PCT Application No. PCT/CN2019/086643 dated Aug. 18, 2019, (4p).

* cited by examiner

DESK LAMP

CROSS-REFERENCE TO RELATED APPLICATIONS

This application is based upon and claims the priority of PCT patent application No. PCT/CN2019/086643 filed on May 13, 2019 which claims priority to the Chinese patent application No. 201820814395.2 filed on May 29, 2018, the entire content of all of which is hereby incorporated by reference herein for all purposes.

TECHNICAL FIELD

The present disclosure relates to the technical field of lighting, in particular to a desk lamp and a method of manufacturing a desk lamp.

BACKGROUND

A desk lamp is a kind of lamp, and is small, exquisite, and portable. The desk lamp is usually placed on the writing desk or the dining table for lighting, and may not affect the light of the entire room. The function of the desk lamp is limited to the area around the desk lamp, which is convenient for reading, studying, working, and saving energy.

SUMMARY

The present disclosure provides a desk lamp, and a method of manufacturing a desk lamp.

The present disclosure provides a desk lamp. The desk lamp may include a lamp cap, a chassis, and a connector connecting the lamp cap and the chassis. The connector may include a plurality of clasps, the chassis may include a plurality of connection holes, and the clasps are matched and clasped with the connection holes so as to connect the connector and the chassis.

The present disclosure also provides a method of manufacturing a desk lamp. The method may include providing a lamp cap and a chassis; providing a connector that connects the lamp cap and the chassis; providing a plurality of clasps for the connector, and providing a plurality of connection holes for the chassis; and matching and clasping the clasps with the connection holes so as to connect the connector and the chassis.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The illustrative examples of the present disclosure and the description thereof are used to explain the present disclosure and do not constitute an improper limitation of the present disclosure. In the drawings.

DETAILED DESCRIPTION

Figure 1:
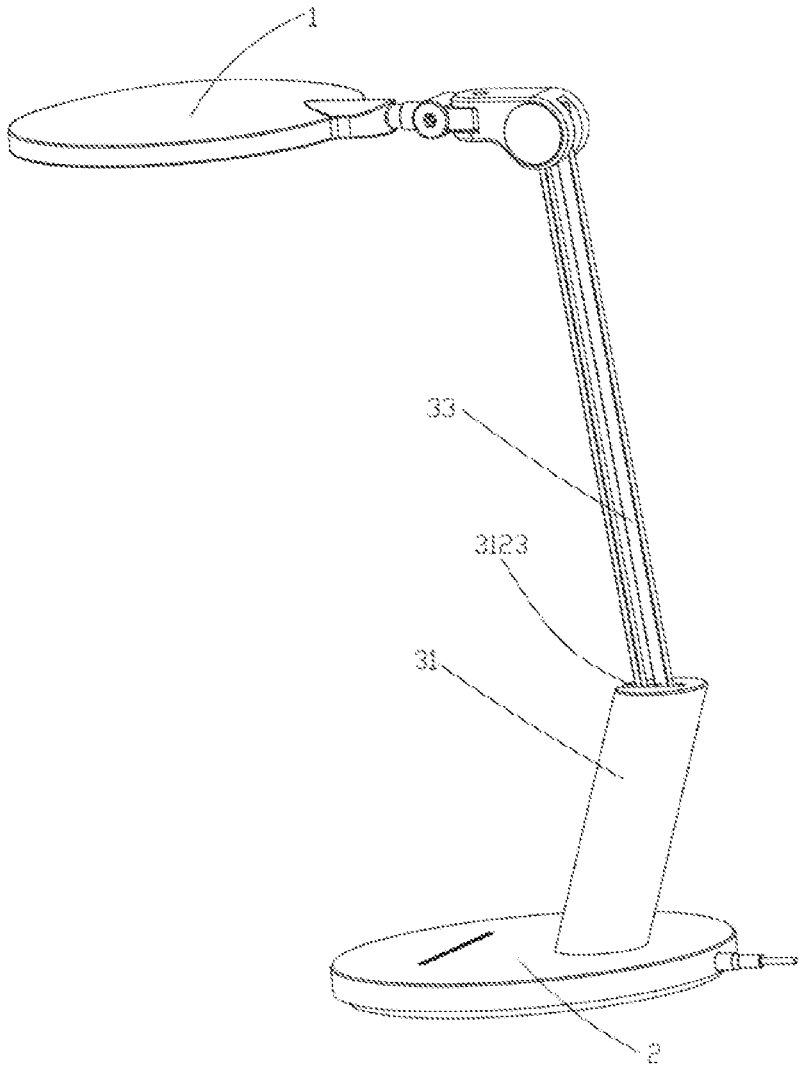
FIG. 1 is a stereogram of a desk lamp according to an example of the present disclosure.

In order to make the purpose, technical solution and advantages of the present disclosure clearer, the technical solution of the present disclosure will be described below in conjunction with the examples of the present disclosure and the corresponding drawings. The described examples are only a part of the examples of the present disclosure, rather than all the examples of the present disclosure. Based on the examples of the present disclosure, all other examples obtained by those of ordinary skill in the art without creative work shall fall within the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals used in this disclosure may include:

1—lamp cap;

2—chassis; 2*a*—connection hole; 2*b*—electrical connection part; 2*b*1—conduction hole; 2*b*2—elastic conductive column; 2*b*3—first plug-in part; 2*b*31—first socket; 2*b*32—first pin; 21—upper shell; 22—lower shell;

3—connector; 3*a*—clasp; 31—connection tube; 311—inner tube; 3111—first positioning hole; 3112—first limiting block; 3113—second positioning column; 312—outer tube; 3121—first positioning column; 3122—first limiting slot; 3123—hole; 31*a*—connection column; 31*b*—second limiting slot; 32—fixing component; 33—connection rod;

4—power supply controller;

5—electrical connection device; 51—conductive terminal; 52—bottom plate; 53—mounting column; 531—second limiting block; 54—terminal column; 55—second plug-in part; 551—second pin; 552—second socket; 56—mounting part; 561—second positioning hole; and

6—weight gaining block.

The desk lamp usually includes a lamp cap, a chassis, and a connector connecting the lamp cap and the chassis. The connector and the chassis are usually fixed and connected by screws, and the like, and the connector and the chassis are not easy to disassemble, which causes the packaging volume of the lamp to be too large and the related packaging cost to be higher when the lamp is for sale and packaged.

Figure 2:
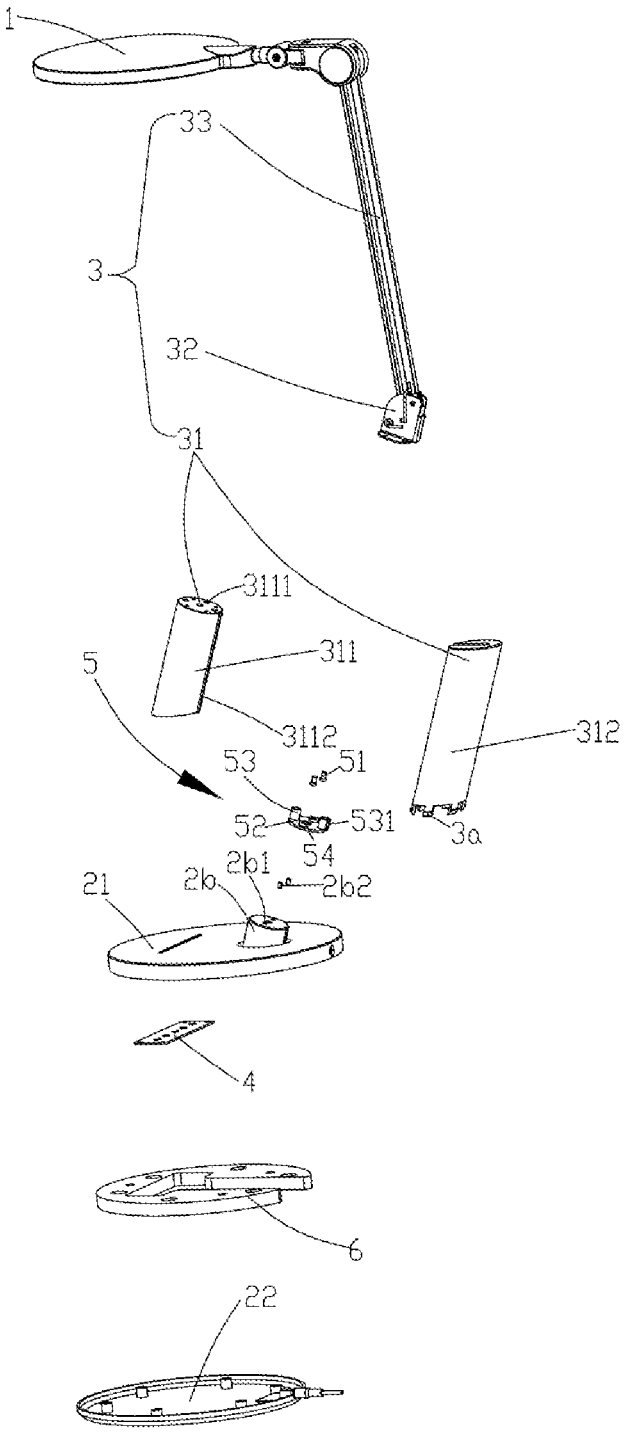
FIG. 2 is an exploded view of the desk lamp illustrated in FIG. 1.
Figure 3:
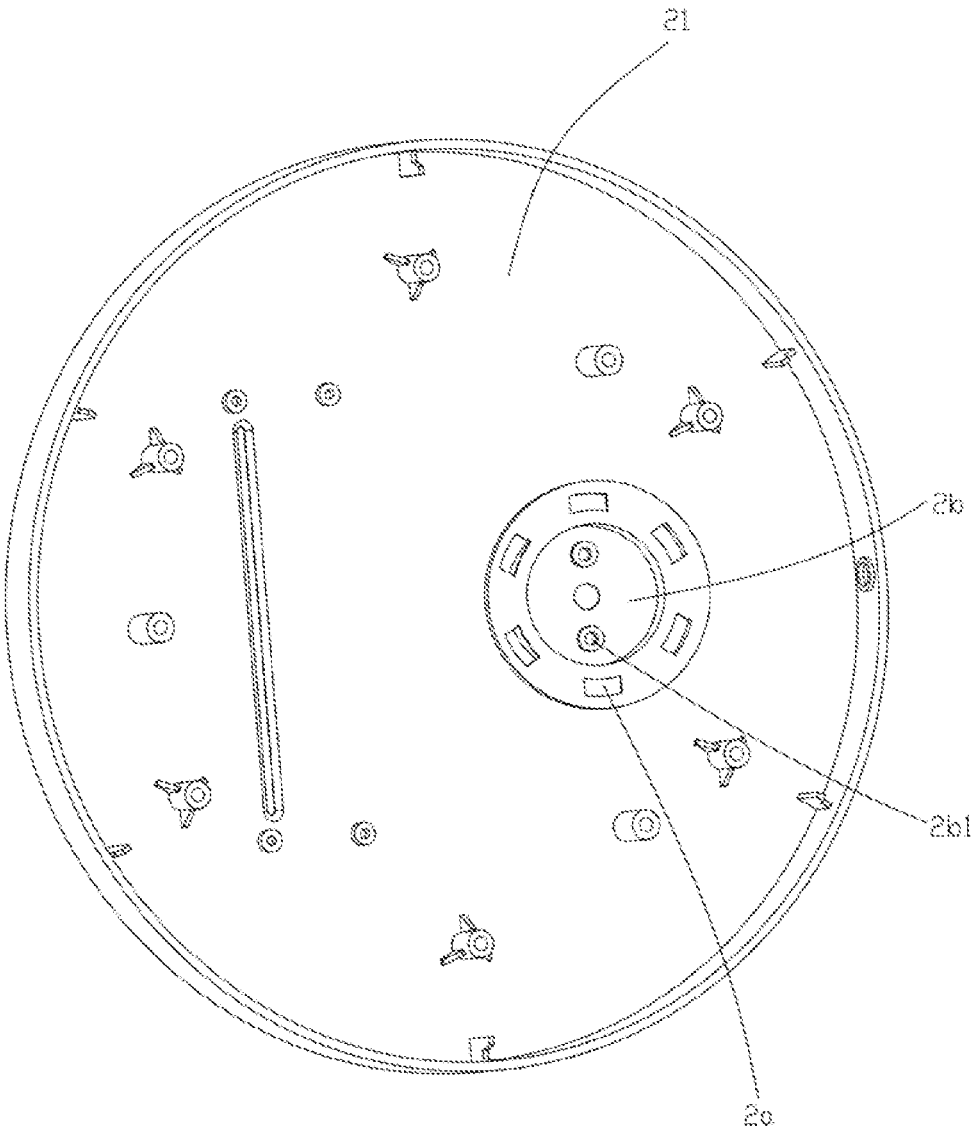
FIG. 3 is a stereogram of another viewing angel of an upper shell of the desk lamp illustrated in FIG. 1.

As illustrated in FIG. 1 to FIG. 3, an example of the present disclosure provides a desk lamp, which includes a lamp cap 1, a chassis 2, and a connector 3 connecting the lamp cap 1 and the chassis 2. The lamp cap 1 has a light source component (not numbered) inside for lighting. The chassis 2 facilitates the placement of the desk lamp. The connector 3 is provided with a plurality of clasps 3*a* at an end close to the chassis 2, the chassis 2 is provided with a plurality of connection holes 2*a*, and the clasps 3*a* and the connection holes 2*a* are matched and clasped so as to connect the connector 3 and the chassis 2, thereby facilitating the disassembly and installation of the connector and the chassis, reducing the packaging volume for sale, and reducing the related packaging cost.

Referring to FIG. 2, the desk lamp usually further includes a power supply controller 4 fixed on the chassis 2 for controlling the turn-on state and the turn-off state of the desk lamp. In order to facilitate the electrical connection with the power supply controller 4, the desk lamp of the present disclosure preferably further includes an electrical connection device 5 provided on the connector 3. In order to facilitate the placement of the electrical connection device 5, the connector 3 may be provided to include a connection tube 31, and the electrical connection device 5 is fixed and contained in the connection tube 31. The clasps 3*a* are located on the connection tube 31, so that the connector 3 is clasped with the chassis 2 through the connection tube 31. The direction of an opening of the connection tube 31 faces the chassis 2, so that in the case where the clasps 3*a* are matched and clasped with the connection holes 2*a*, the electrical connection device 5 is electrically connected to the power supply controller 4. It should be noted that the connection tube 31 may be in any cylindrical shape, such as a cylinder, a square cylinder, a conical cylinder, etc., and the radial cross-sectional shape of the space in the tube may also be any shape, such as a circle, a square, a triangle, a trapezoid, etc.

The connector 3 may further include a fixing component 32 and a connection rod 33. The fixing component 32 is provided on a side of the connection tube 31 opposite to the opening. That is, the fixing component 32 is provided on the connection tube 31 and is located on the other side of the connection tube 31 opposite to the opening side. An end of the connection rod 33 is in rotated connection to the fixing component 32, and the other end of the connection rod 33 is connected to the lamp cap 1, so that the lamp cap 1 can be rotated under the driving of the connection rod 33. Certainly, the lamp cap 1 may also be in rotated connection to the connection rod 33, so that the lamp cap 1 can rotate relative to the connection rod 33.

Figure 4:
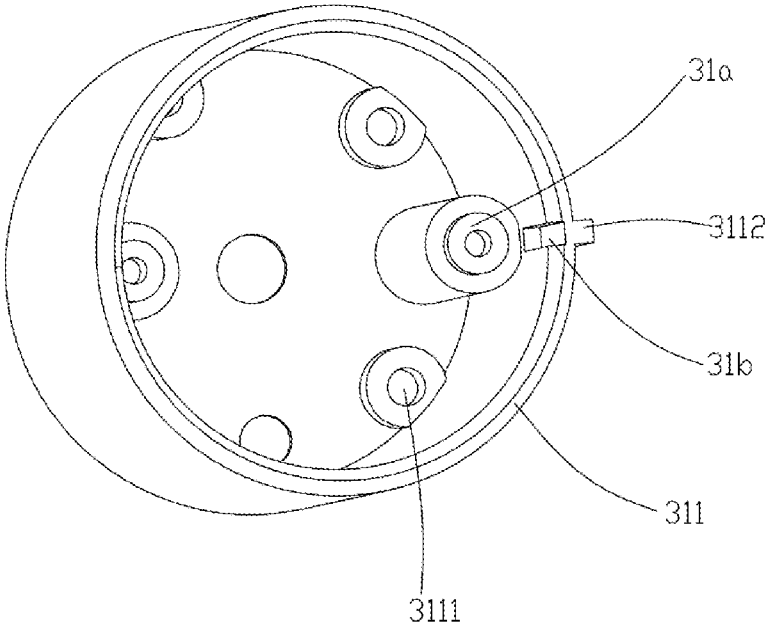
FIG. 4 is a stereogram of another viewing angel of an inner tube of the desk lamp illustrated in FIG. 1.
Figure 5:
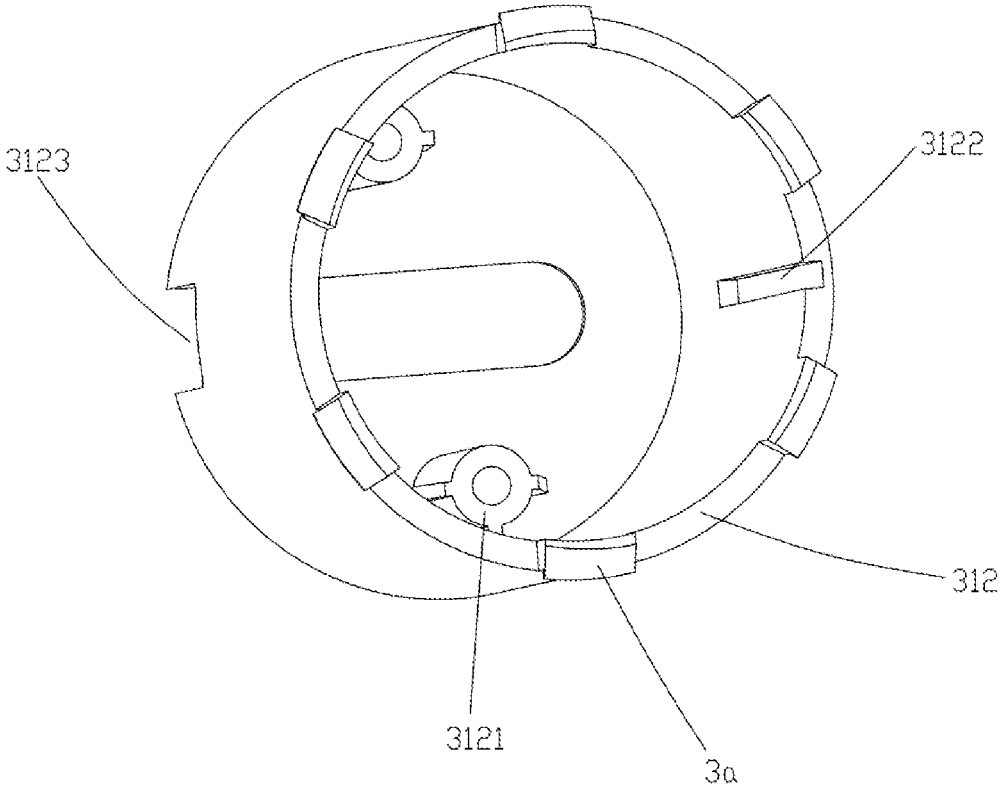
FIG. 5 is a stereogram of another viewing angel of an outer tube of the desk lamp illustrated in FIG. 1.
Figure 6:
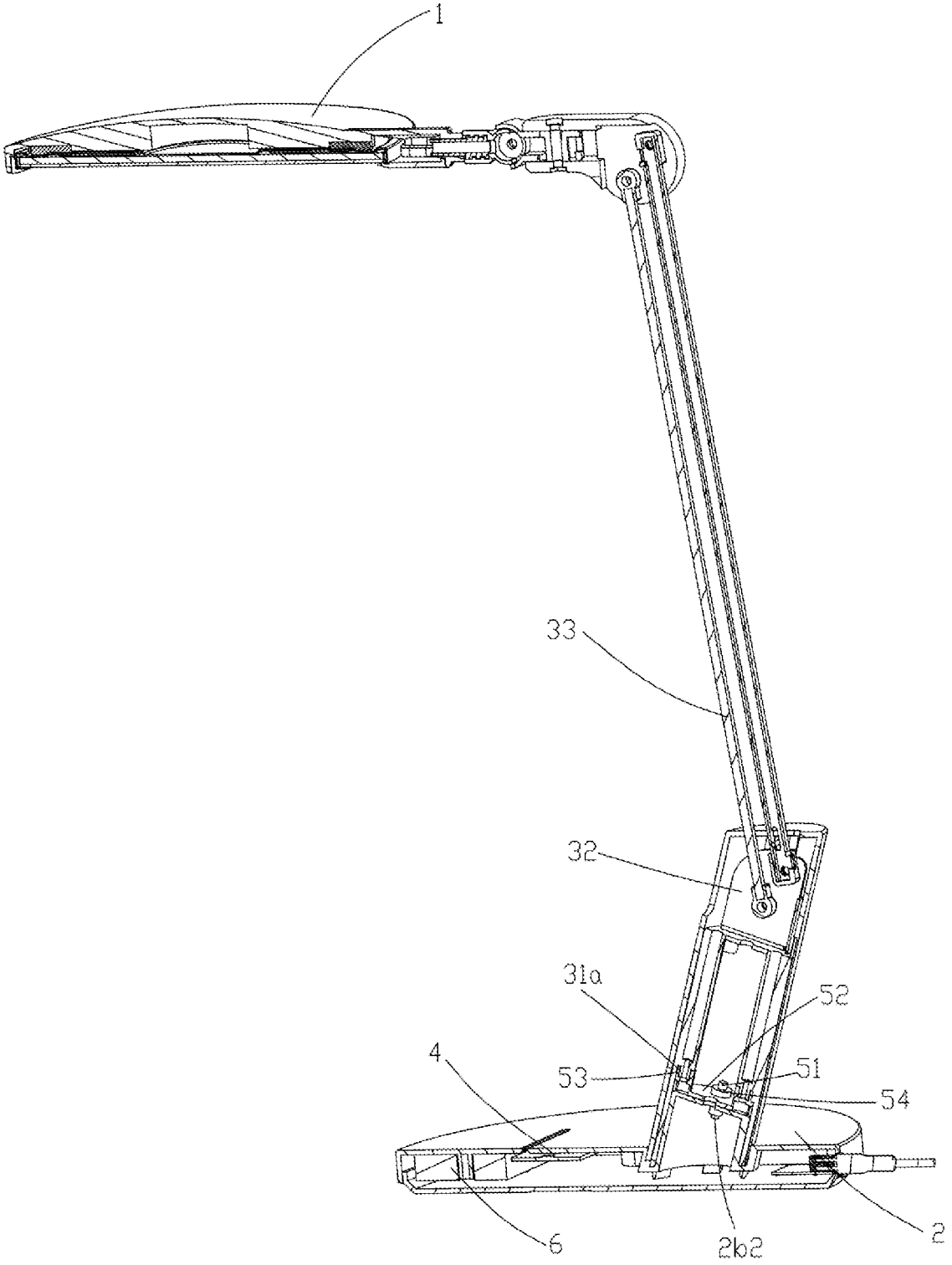
FIG. 6 is a cross-sectional view of the desk lamp illustrated in FIG. 5.

The fixing component 32 can be fixed and connected to the connection tube 31 by using screws (not illustrated in the figure). In order to prevent the connection portion between the fixing component 32 and the connection tube 31 from being exposed to the outside and affecting the appearance of the lamp, the connection tube 31 preferably includes an inner tube 311 and an outer tube 312. Referring to FIG. 4 to FIG. 6, the outer tube 312 can be fixed outside the inner tube 311 by screws or the like. Specifically, a hollow first positioning column 3121 can be formed in the outer tube 312, the inner tube 311 is provided with a corresponding first positioning hole 3111, and the first positioning column 3121 and the first positioning hole 3111 cooperate with a screw (not illustrated in the figure) so that the outer tube 312 is fixed outside the inner tube 311. Besides, in order to facilitate the assembly of the inner tube 311 and the outer tube 312, a first limiting block 3112 can be provided on the inner tube 311, a first limiting slot 3122 is correspondingly provided on the outer tube 312, and the first limiting block 3112 and the first limiting slot 3122 cooperate to limit the relative position of the inner tube 311 and the outer tube 312. Meanwhile, the outer tube 312 has a hole 3123 (with reference to FIG. 1 and FIG. 5) for the connection rod 33 to pass through. In order to facilitate the connection, the clasps 3*a* may be provided on the outer tube 312, and of course, may also be provided on the inner tube 311. The electrical connection device 5 is fixed and contained in the inner tube 311. The fixing component 32 is connected to the inner tube 311 and is contained in a containing space enclosed by the outer tube 312 and the inner tube 311, thereby concealing the connection portion between the fixing component 32 and the connection tube 31, and enabling the lamp to be beautiful and elegant. Certainly, the connection tube 31 may not include the outer tube 312 but only include the inner tube, and in this case, the clasps 3*a* may be formed on the inner tube 311.

In order to facilitate the electrical connection between the power supply controller 4 and an external power supply (not illustrated in the figure), the chassis 2 can be provided with a containing cavity, and the power supply controller 4 is located in the containing cavity. Meanwhile, the containing cavity can also contain a weight gaining block 6 to increase the weight of the chassis 2 and prevent the desk lamp from toppling over due to the heavy weight of the lamp cap 1. An electrical connection part 2*b* may be provided on a side of the chassis 2. The electrical connection part 2*b* extends into the containing cavity and is electrically connected to the power supply controller 4. The plurality of connection holes 2*a* surround the electrical connection part 2*b*, so that in the case where the clasps 3*a* on the connection tube 31 are clasped with the connection holes 2*a*, the electrical connection device 5 contained in the connection tube 31 can be conveniently in electrical connection to the electrical connection part 2*b*, and further electrically connected to the power supply controller 4 through the electrical connection part 2*b*. The electrical connection part 2*b* preferably protrudes toward the connector 3, and the connection tube 31 is set outside the electrical connection part 2*b*, so as to facilitate the arrangement of related components cooperating with the electrical connection device 5 in the chassis 2.

In an example of the present disclosure, referring to FIG. 2 to FIG. 6, the chassis 2 includes an upper shell 21 and a lower shell 22, and the upper shell 21 and the lower shell 22 are connected to form the containing cavity. The electrical connection part 2*b* is provided on the upper shell 21. Certainly, the chassis 2 of the present disclosure may not be divided into the upper shell 21 and the lower shell 22, but may be a complete shell forming the containing cavity, which is not limited in the present disclosure. The electrical connection part 2*b* has a conduction hole 2*b*1 connected to the containing cavity, and an elastic conductive column 2*b*2 is installed in the conduction hole 2*b*1. The power supply controller 4 is located in the containing cavity and is electrically connected to the elastic conductive column 2*b*2 through a wire (not illustrated in the figure). The electrical connection device 5 includes a conductive terminal 51. Because the elastic conductive column 2*b*2 has elasticity, before the connection tube 31 is assembled to the chassis 2 through the clasps 3*a* on the outer tube 312, the elastic conductive column 2*b*2 protrudes toward the connection rod 3 relative to the surface of the electrical connection part 2*b*. In the case where the connection tube 31 is assembled to the chassis 2 through the clasps 3*a* on the outer tube 312, because the outer tube 312 and the inner tube 311 are fixed to each other, and the electrical connection device 5 is fixed and contained in the inner tube 311, the conductive terminal 51 of the electrical connection device 5 can be in elastic contact with the elastic conductive column 2*b*2 to conduct electricity, so that the electrical connection device 5 and the power supply controller 4 are electrically connected well.

The electrical connection device 5 may further include a bottom plate 52, a mounting column 53, and a terminal column 54. A side of the bottom plate 52 faces the chassis 2, the other side of the bottom plate 52 is away from the chassis 2, and the mounting column 53 and the terminal column 54 are installed on the side of the bottom plate 52 away from the chassis 2. The mounting column 53 is hollow, the inner tube 311 of the connection tube 31 has a connection column 31*a* inside, and the connection column 31*a* can be plugged into the mounting column 53, so that the electrical connection device 5 is fixed on the connection tube 31 through the mounting column 53. Meanwhile, a second limiting block 531 can be formed on the mounting column 53, a second limiting slot 31*b* is formed on the inner tube 311 accordingly, and the second limiting block 531 cooperates with the second limiting slot 31*b* to limit the position, thereby facilitating the assembly of the electrical connection device 5 and the connection tube 31.

The bottom plate 52 and the terminal column 54 are formed with a first through hole and a second through hole, respectively, the conductive terminal 51 sequentially penetrates the bottom plate 52 and the terminal column 54 through the first through hole and the second through hole. The second through hole can be interference fit with the conductive terminal 51 so as to fix the conductive terminal 51. The diameter of the part of the conductive terminal 51 located in the bottom plate 52 and the terminal column 54 is equivalent to the aperture of the first through hole. Therefore, in order to accurately position the conductive terminal 51 in the bottom plate 52 and the terminal column 54, the apertures of the first through hole and the second through hole are set to be different, so that the conductive terminal 51 can be accurately positioned. Meanwhile, in order to allow the conductive terminal 51 to be in good contact with the elastic conductive column 2*b*2, the aperture of the first through hole can be designed to be larger than the aperture of the second through hole, and larger than the diameter of the elastic conductive column 2*b*2, so that the diameter of the part of the conductive terminal 51 contained in the first through hole is larger than the diameter of the elastic conductive column 2*b*2. In the case where the conductive terminal 51 is level with the surface of the bottom plate 52 on the side close to the chassis, the bottom plate 52 and the electrical connection part 2*b* can abut against each other after the conductive terminal 51 and the elastic conductive column 2*b*2 elastically contact with each other.

Figure 7:
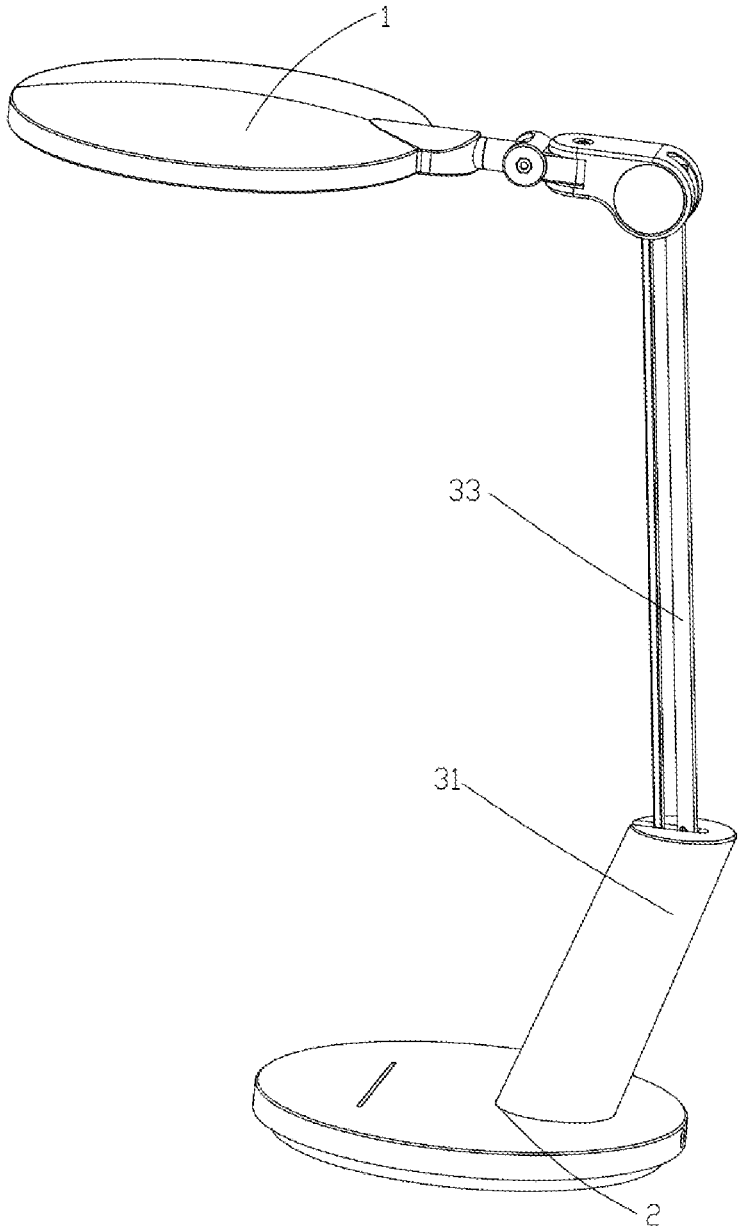
FIG. 7 is a stereogram of a desk lamp according to another example of the present disclosure.
Figure 8:
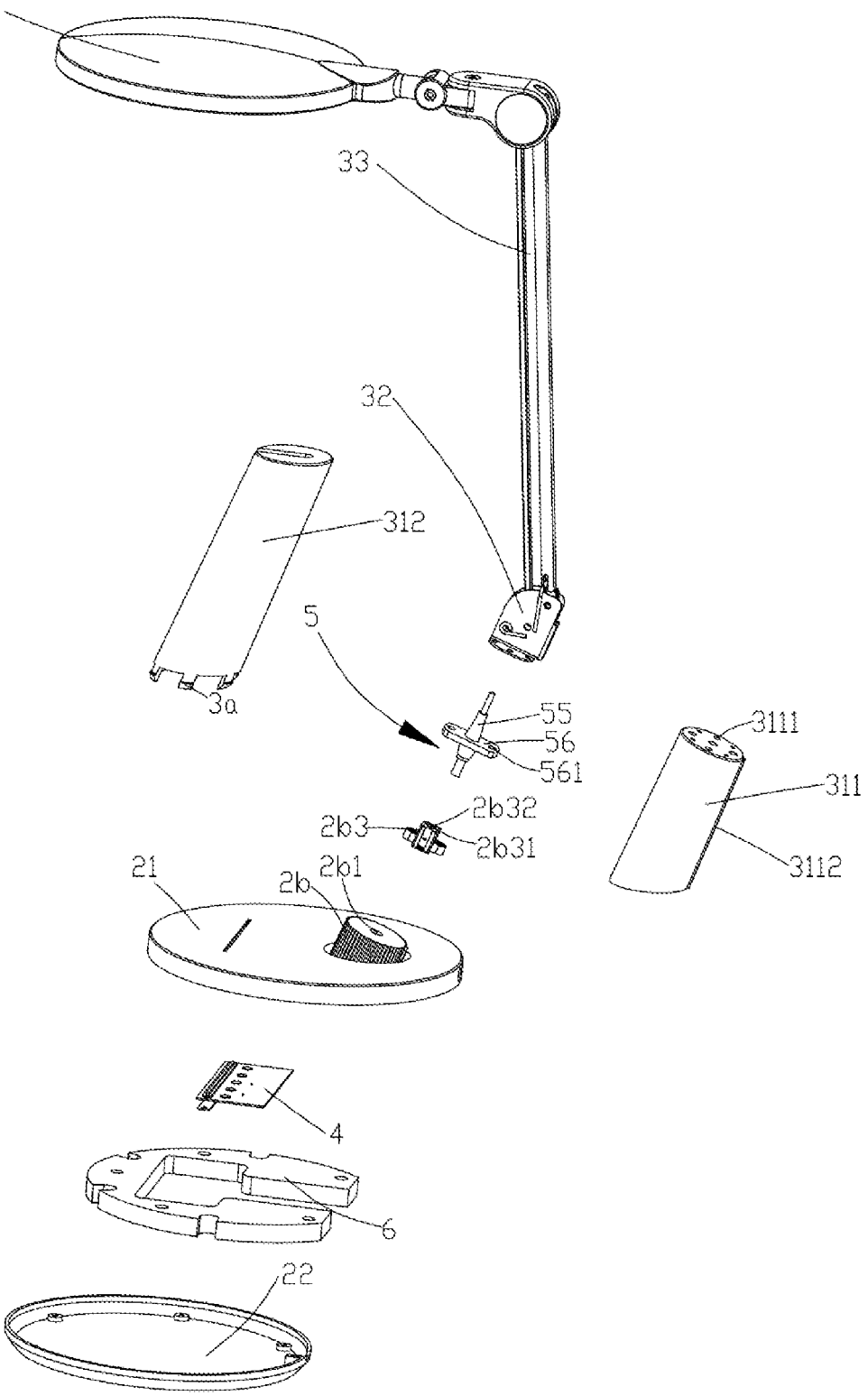
FIG. 8 is an exploded view of the desk lamp illustrated in FIG. 7.
Figure 9:
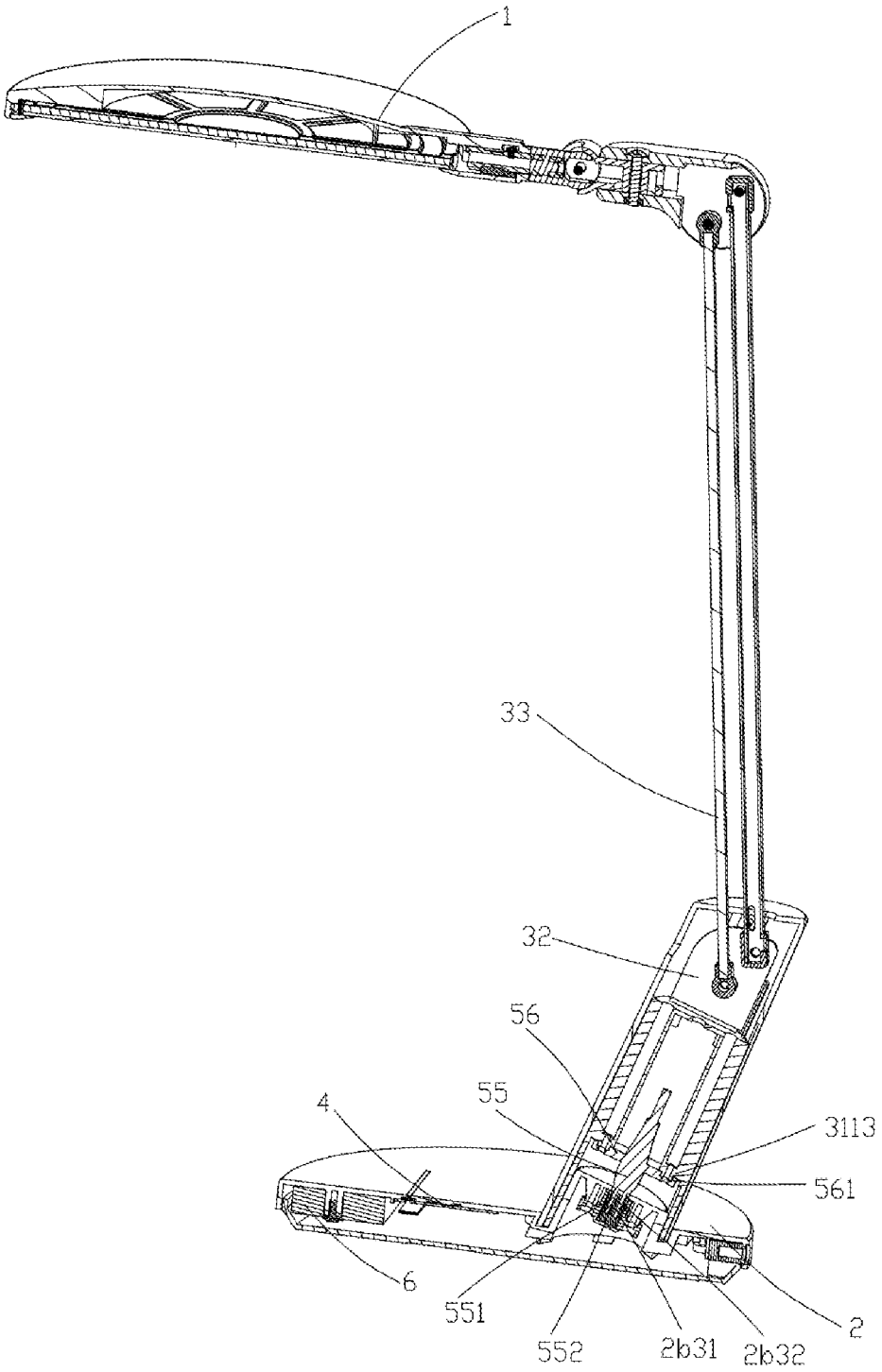
FIG. 9 is a cross-sectional view of the desk lamp illustrated in FIG. 7.

Referring to FIG. 7 to FIG. 9, in another example of the present disclosure, a first plug-in part 2*b*3 is installed in the conduction hole 2*b*1 of the electrical connection part 2*b*. The power supply controller 4 is located in the containing cavity and is electrically connected to the first plug-in part 2*b*3 through wires (not illustrated in the figure). The first plug-in part 2*b*3 has a first socket 2*b*31, and the center of the first socket 2*b*31 has a first pin 2*b*32. The electrical connection device 5 includes a second plug-in part 55, the second plug-in part 55 has a second pin 551, and the center of the second pin 551 has a second socket 552. In the case where the connection tube 31 is assembled to the chassis 2 through the clasps 3*a*, because the electrical connection device 5 is fixed on the connection tube 31, the second plug-in part 55 can be plugged into and electrically connected to the first plug-in part 2*b*3. Specifically, the second pin 551 is plugged into the first socket 2*b*31, and the first pin 2*b*32 is plugged into the second socket 552 at the same time. Thus, the electrical connection device 5 is electrically connected to the power supply controller 4.

In this case, the electrical connection device 5 further includes a mounting part 56, the second plug-in part 55 penetrates the mounting part 56, and the mounting part 56 is fixed on the connection tube 31. Specifically, the mounting part 56 has a second positioning hole 561, and the inner tube 311 of the connection tube 31 has a hollow second positioning column 3113. The second positioning hole 561 and the second positioning column 3113 cooperate with screws (not illustrated in the figure), so that the electrical connection device 5 is fixed on the connection tube 31.

In summary, in the desk lamp provided by the present disclosure, the connector is provided with a plurality of clasps, the chassis is provided with a plurality of connection holes, and the clasps are matched and clasped with the connection holes so as to connect the connector and the chassis, thereby facilitating the disassembly and installation of the connector and the chassis, reducing the packaging volume for sale, and reducing the relevant packaging cost.

The present disclosure provides a desk lamp, and a method of manufacturing a desk lamp.

A desk lamp may include a lamp cap, a chassis, and a connector connecting the lamp cap and the chassis. The connector is provided with a plurality of clasps, the chassis is provided with a plurality of connection holes, and the clasps are matched and clasped with the connection holes so as to connect the connector and the chassis.

Further, the desk lamp may further include an electrical connection device and a power supply controller, the electrical connection device is on the connector, the power supply controller is fixed on the chassis, and in the case where the clasps are matched and clasped with the connection holes, the electrical connection device is electrically connected to the power supply controller.

Further, the connector may include a connection tube, a direction of an opening of the connection tube faces the chassis, the clasps are on the connection tube, and the electrical connection device is contained in the connection tube.

Further, the chassis has a containing cavity inside, the power supply controller is contained in the containing cavity, an electrical connection part is provided on a side of the chassis and the electrical connection part extends into the containing cavity and is electrically connected to the power supply controller, the plurality of connection holes are around the electrical connection part, and in the case where the clasps are matched and clasped with the connection holes, the electrical connection device is electrically connected to the electrical connection part.

Further, the electrical connection part may include a conduction hole connecting to the containing cavity, and an elastic conductive column installed in the conduction hole, the elastic conductive column is electrically connected to the power supply controller, the electrical connection device comprises a conductive terminal, and in the case where the clasps are matched and clasped with the connection holes, the conductive terminal is in elastic contact with the elastic conductive column so as to conduct electricity.

Further, the electrical connection device may include a bottom plate, a mounting column, and a terminal column, a side of the bottom plate faces the chassis, another side of the bottom plate is away from the chassis, the mounting column and the terminal column are installed on the side of the bottom plate away from the chassis, the conductive terminal penetrates the terminal column and the bottom plate, and the mounting column is fixed on the connection tube.

Further, the electrical connection part may include a conduction hole connecting to the containing cavity, and a first plug-in part installed in the conduction hole, the first plug-in part is electrically connected to the power supply controller, the electrical connection device comprises a second plug-in part, and the second plug-in part is plugged into the first plug-in part so as to conduct electricity.

Further, the electrical connection device may include a mounting part, the second plug-in part penetrates the mounting part, and the mounting part is fixed on the connection tube.

Further, the connector further may include a fixing component and a connection rod, the lamp cap and the chassis are on different sides of the connection tube, the fixing component is on a side of the connection tube opposite to the opening, an end of the connection rod is in rotated connection to the fixing component, and another end of the connection rod is connected to the lamp cap.

Further, the connection tube may include an inner tube and an outer tube, the outer tube is fixed outside the inner tube and has a hole for the connection rod to pass through, the clasps are on the outer tube, the electrical connection device is fixed and contained in the inner tube, and the fixing component is connected to the inner tube and is contained in a containing space enclosed by the outer tube and the inner tube.

Further, the electrical connection part protrudes toward the connector, and the connection tube is set outside the electrical connection part.

Compared with other implementations, in the desk lamp provided by the present disclosure, the connector is provided with a plurality of clasps, the chassis is provided with a plurality of connection holes, and the clasps are matched and clasped with the connection holes so as to connect the connector and the chassis, thereby facilitating the disassembly and installation of the connector and the chassis, reducing the packaging volume for sale, and reducing the relevant packaging cost.

The present disclosure provides a method of manufacturing a desk lamp. The method may include providing a lamp cap and a chassis; providing a connector that connects the lamp cap and the chassis; providing a plurality of clasps for the connector, and providing a plurality of connection holes for the chassis; and matching and clasping the clasps with the connection holes so as to connect the connector and the chassis.

The method may also include providing an electrical connection device and a power supply controller for the desk lamp; placing the electrical connection device on the connector; fixing the power supply controller on the chassis, and in a case where the clasps are matched and clasped with the connection holes, electrically connecting the electrical connection device to the power supply controller.

The method may include providing a connection tube for the connector; facing the chassis to a direction of an opening of the connection tube; placing the clasps on the connection tube; and containing the electrical connection device in the connection tube.

The method may include providing a containing cavity inside for the chassis; containing the power supply controller in the containing cavity; placing an electrical connection part on a side of the chassis and extending the electrical connection part into the containing cavity and electrically connecting the electrical connection part to the power supply controller; and placing the plurality of connection holes around the electrical connection part, and in the case where the clasps are matched and clasped with the connection holes, electrically connecting the electrical connection device to the electrical connection part.

The method may include providing a conduction hole connecting to the containing cavity and an elastic conductive column installed in the conduction hole for the electrical connection part; electrically connecting the elastic conductive column to the power supply controller; and providing a conductive terminal for the electrical connection device, and in the case where the clasps are matched and clasped with the connection holes, elastically contacting the conductive terminal with the elastic conductive column so as to conduct electricity.

The method may further include providing a bottom plate, a mounting column, and a terminal column for the electrical connection device; facing a side of the bottom plate to the chassis, and placing another side of the bottom plate away from the chassis; installing the mounting column and the terminal column on the side of the bottom plate away from the chassis; penetrating, by the conductive terminal, the terminal column and the bottom plate; and fixing the mounting column on the connection tube.

The examples described above further describe the purpose, technical solutions and beneficial effects of the present disclosure in detail. It should be understood that the above descriptions are only examples of the present disclosure and are not intended to limit the present disclosure. Any modification, equivalent replacement, improvement, etc. made within the spirit and principle of the present disclosure shall be included in the protection scope of the present disclosure.

What is claimed is:

1. A desk lamp, comprising a lamp cap, a chassis, a connector connecting the lamp cap and the chassis, and an electrical connection device, wherein the connector comprises a plurality of clasps, the chassis comprises a plurality of connection holes, and the clasps are matched and clasped with the connection holes so as to connect the connector and the chassis;

wherein the electrical connection device further comprises a bottom plate, a mounting column, and a terminal column, wherein a side of the bottom plate faces the chassis, another side of the bottom plate is away from the chassis, the mounting column and the terminal column are installed on the side of the bottom plate away from the chassis, a conductive terminal penetrates the terminal column and the bottom plate, and the mounting column is fixed on a connection tube of the connector.

2. The desk lamp according to claim 1, wherein the desk lamp further comprises a power supply controller, wherein the electrical connection device is on the connector, the power supply controller is fixed on the chassis, and in a case where the clasps are matched and clasped with the connection holes, the electrical connection device is electrically connected to the power supply controller.

3. The desk lamp according to claim 2, wherein the connector comprises the connection tube, wherein a direction of an opening of the connection tube faces the chassis, the clasps are on the connection tube, and the electrical connection device is contained in the connection tube.

4. The desk lamp according to claim 3, wherein the chassis has a containing cavity inside, wherein the power supply controller is contained in the containing cavity, an electrical connection part is on a side of the chassis and the electrical connection part extends into the containing cavity and is electrically connected to the power supply controller, the plurality of connection holes are around the electrical connection part, and in the case where the clasps are matched and clasped with the connection holes, the electrical connection device is electrically connected to the electrical connection part.

5. The desk lamp according to claim 4, wherein the electrical connection part comprises a conduction hole connecting to the containing cavity, and an elastic conductive column installed in the conduction hole, wherein the elastic conductive column is electrically connected to the power supply controller, the electrical connection device comprises the conductive terminal, and in the case where the clasps are matched and clasped with the connection holes, the conductive terminal is in elastic contact with the elastic conductive column so as to conduct electricity.

6. The desk lamp according to claim 4, wherein the electrical connection part comprises a conduction hole connecting to the containing cavity, and a first plug-in part installed in the conduction hole, wherein the first plug-in part is electrically connected to the power supply controller, the electrical connection device comprises a second plug-in part, and the second plug-in part is plugged into the first plug-in part so as to conduct electricity.

7. The desk lamp according to claim 6, wherein the electrical connection device further comprises a mounting part, wherein the second plug-in part penetrates the mounting part, and the mounting part is fixed on the connection tube.

8. The desk lamp according to claim 4, wherein the electrical connection part protrudes toward the connector, and the connection tube is set outside the electrical connection part.

9. The desk lamp according to claim 3, wherein the connector further comprises a fixing component and a connection rod, wherein the lamp cap and the chassis are on different sides of the connection tube, the fixing component is on a side of the connection tube opposite to the opening, an end of the connection rod is in rotated connection to the fixing component, and another end of the connection rod is connected to the lamp cap.

10. The desk lamp according to claim 9, wherein the connection tube comprises an inner tube and an outer tube, wherein the outer tube is fixed outside the inner tube and has a hole for the connection rod to pass through, the clasps are on the outer tube, the electrical connection device is fixed and contained in the inner tube, and the fixing component is connected to the inner tube and is contained in a containing space enclosed by the outer tube and the inner tube.

11. A method of manufacturing a desk lamp, comprising:

providing a lamp cap and a chassis;

providing a connector that connects the lamp cap and the chassis;

providing a plurality of clasps for the connector, and providing a plurality of connection holes for the chassis;

providing an electrical connection device;

matching and clasping the clasps with the connection holes so as to connect the connector and the chassis;

providing a bottom plate, a mounting column, and a terminal column for the electrical connection device;

facing a side of the bottom plate to the chassis, and placing another side of the bottom plate away from the chassis;

installing the mounting column and the terminal column on the side of the bottom plate away from the chassis;

penetrating, by a conductive terminal, the terminal column and the bottom plate; and fixing the mounting column on a connection tube of the connector.

12. The method of claim 11, further comprising:

providing a power supply controller for the desk lamp;

placing the electrical connection device on the connector;

fixing the power supply controller on the chassis, and in a case where the clasps are matched and clasped with the connection holes, electrically connecting the electrical connection device to the power supply controller.

13. The method of claim 12, further comprising:

providing the connection tube for the connector;

facing the chassis to a direction of an opening of the connection tube;

placing the clasps on the connection tube; and containing the electrical connection device in the connection tube.

14. The method of claim 13, further comprising:

providing a containing cavity inside for the chassis;

containing the power supply controller in the containing cavity;

placing an electrical connection part on a side of the chassis and extending the electrical connection part into the containing cavity and electrically connecting the electrical connection part to the power supply controller; and placing the plurality of connection holes around the electrical connection part, and in the case where the clasps are matched and clasped with the connection holes, electrically connecting the electrical connection device to the electrical connection part.

15. The method of claim 14, further comprising:

providing a conduction hole connecting to the containing cavity and an elastic conductive column installed in the conduction hole for the electrical connection part;

electrically connecting the elastic conductive column to the power supply controller; and providing the conductive terminal for the electrical connection device, and in the case where the clasps are matched and clasped with the connection holes, elastically contacting the conductive terminal with the elastic conductive column so as to conduct electricity.

* * * * *